United States Patent [19]

Fujita

[11] 4,157,463

[45] Jun. 5, 1979

[54] SWITCH APPARATUS

[75] Inventor: Teizo Fujita, Ibaraki, Japan

[73] Assignee: Izumi Denki Corporation, Osaka, Japan

[21] Appl. No.: 829,113

[22] Filed: Aug. 3, 1977

[30] Foreign Application Priority Data

Sep. 14, 1976 [JP] Japan ..... 51-110552

[51] Int. Cl.[2] ..... H01H 9/02

[52] U.S. Cl. ..... 200/307; 200/16 A

[58] Field of Search ..... 200/5 B, 16 A, 16 C, 200/159 R, 296, 307

[56] References Cited

U.S. PATENT DOCUMENTS

| | | | |
|---|---|---|---|
| 3,018,338 | 1/1962 | Mullen et al. | 200/296 |
| 3,231,706 | 1/1966 | Waldorf | 200/307 |
| 3,267,246 | 8/1966 | Manning | 200/307 |
| 3,514,554 | 5/1970 | Boysen | 200/16 A |
| 3,586,795 | 6/1971 | Mentel | 200/307 |
| 3,614,363 | 10/1971 | Fujita | 200/307 |
| 4,029,924 | 6/1977 | Frank et al. | 200/16 A |
| 4,052,582 | 10/1977 | Mullen et al. | 200/16 A |
| 4,064,381 | 12/1977 | Mullen et al. | 200/16 A |

*Primary Examiner*—Herbert F. Ross

*Attorney, Agent, or Firm*—Pollock, Vande Sande & Priddy

[57] ABSTRACT

A switch apparatus comprises at least one contact block which is adapted to be connected with other contact blocks similar thereto in multiple stages quickly and easily. Each contact block includes a casing, a connector for causing the contact block to mechanically engage the casing of another contact block similar in shape or a lamp transformer block, at least one electrical contact contained in the casing, and a contact actuator member for actuating the contact. The contact actuator member is supported movably between a first position where the contact is unactuated and a second position where it is actuated. The contact actuator member is normally urged to the first position by bias means such as springs. In assemblying the contact blocks, the contact actuator member may be selected from a group consisting of plural contact actuator members in various forms so as to actuate the contact blocks in upper and lower stages in either the same or different operation mode. The casing of each contact block may be electrically separately embedded with a pair of conductors or provided with a hollow pillar portion at the center thereof, so that the conductors may connect an indication lamp disposed on the top of the contact block to the output terminals of the lowest-stage transformer block or so that a lead-out member of the lowest-stage transformer block leading to an indication lamp may be inserted through the hollow portion of the casing to provide a simple indication lamp.

30 Claims, 18 Drawing Figures

SWITCH APPARATUS

BACKGROUND OF THE INVENTION

1. Field of the Invention

This invention relates to a switch apparatus or more in particular to contact blocks with a novel construction for making up a compact switch convenient for a complicated circuit operation.

2. Description of the Prior Art

The use of electrical devices and appliances has remarkably spread in all fields of industry for various purposes and applications. In order to control these electrical devices and appliances for various purposes and applications in various processes and sequences, switch mechanisms suitable for such varieties of purposes and applications are required. The stocking of these switch mechanisms suitable for various purposes and objects to supply them in immediate response to the demand is uneconomical as it is a waste of both money and space. To overcome this disadvantage, a method is suggested wherein different types of contact units or blocks are prepared in advance and several of them are assembled together to construct one control switch, so that a single actuator member actuates a plurality of contacts at the same time, as disclosed in U.S. Pat. No. 3,018,338. The conventional methods of assembly of the contact units or blocks, however, are not necessarily easy to implement. Further, the fact that the operation mode of each contact unit is so simple that it is impossible to satisfy complicated operation modes required of a switch mechanism.

SUMMARY OF THE INVENTION

Accordingly, it is an object of the present invention to provide a switch apparatus comprising a plurality of contact blocks easily assembled in multiple stages, which is operable either in the same or different mode for the upper and lower stages of contact blocks by properly selecting contact actuator members from a group consisting of several different types of contact actuator members prepared in advance.

Another object of the invention is to provide a switch apparatus construction to which an indication lamp is easily attached by embedding conductors passing through each contact block or by forming a hollow pillar portion at its center in the direction of the coupling thereof, through which hollow portion the lead-out member to the indication lamp of the transformer located at the lowest stage may be inserted.

Still another object of the present invention is to provide a connector for quickly and easily coupling between two contact blocks, between a contact block and a transformer block, or between a contact block and a switching operation control section.

The above and other objects and features of the present invention will become apparent when reading the following detailed description of preferred embodiments of the invention in conjunction with the accompanying drawings.

DETAILED DESCRIPTION OF THE PREFERRED EMBODIMENTS

Preferred embodiments of the present invention will be described below in detail with reference to the accompanying drawings.

Figure 1:
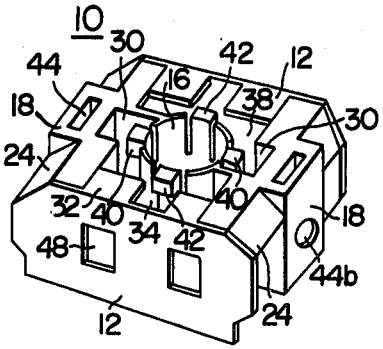
FIG. 1 is a perspective view showing an embodiment of the casing for a contact block according to the present invention.
Figure 2:
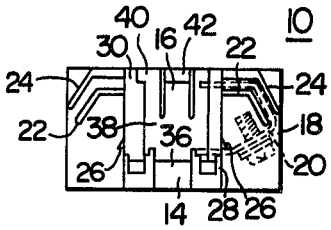
FIG. 2 is an elevational view in which the side plate of the casing of FIG. 1 is removed to make the inside thereof visible.

A perspective view of a casing generally designated by reference numeral 10 for constructing the contact block of the switch apparatus according to the present invention is shown in FIG. 1. A front view of the casing with a side plate 12 thereof removed to make the inside thereof visible is shown in FIG. 2. The casing 10 may be formed by use of a thermosetting resin or other electrically insulating material such as a phenol resin or urea resin, and is generally cubic in shape. The casing 10 comprises a base portion 14, a hollow cylinder portion 16 rising from the center of the base portion 14, and a couple of pillar portions 18, 18 rising from the opposite end portions of the base portion 14, all of which are integrated with the base portion 14. On the outer side of each of the pillar portions 18, 18, there are integrally formed a ledge 26 and shelves 22, 24 protruded from the pillar portions 18 in parallel with the base portion 14 for mounting and holding the lead-out terminals 20 shown with a phantom image. Each of the lead-out terminals 20 is held between the shelves 22, 24 respectively on the one hand and between each of the mounts 28 on the base portion 14 and the ledge 26 on the other hand. Between each of the pillar portions 18, 18 and the cylinder portion 16, there is formed an aperture 30 through which the contact actuator member described later is inserted. From the upper edges of the side plates 12, 12, ceiling plates 32, 32 integral therewith extend inwardly in the direction perpendicular thereto. The ceiling plates 32, 32 each has a notch 34. Another actuator member is adapted to be inserted through the notch 34 and a space 36 formed between the mounts 28, 28. Spaces 38, 38 defined by the side plate 12, the ceiling plate 32, the base portion 14 and the cylinder portion 16 and communicating with the apertures 30, 30 function as a contact chamber which contains the contact actuator member and a normally open contact and/or normally closed contact actuated thereby. The side plates 12, 12 of the casing 10 are formed separately from the other parts thereof, and bonded with a bonding agent or the like to the casing 10 after the contact actuator member and the contacts are assembled. Slits are formed at the top of the cylinder portion 16. Between adjacent slits, protrusions 40, 40 and 42, 42 extend toward the apertures 30, 30 and the notches 34, 34 respectively, in order to prevent the contact actuator member mounted from jumping out.

Figure 3:
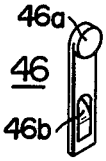
FIG. 3 is a perspective view showing an embodiment of the connector for connecting the contact blocks according to the present invention.
Figure 12:
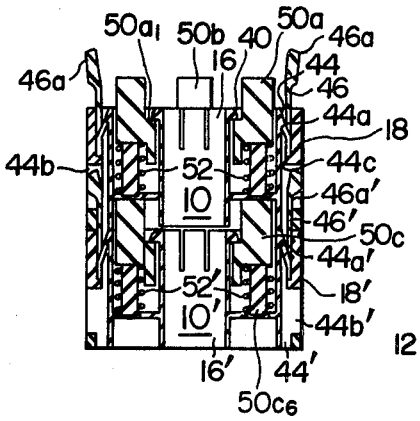
FIG. 12 is a longitudinal sectional view showing the coupled condition of the contact block of FIG. 8 and that of FIG. 10.

The pillar portions 18, 18 have longitudinal through holes 44, 44 respectively, which are adapted to engage a connector 46 as shown in FIG. 3. More specifically, it will be noted from FIG. 3 that a first engaging portion **46*a* is formed at an end or upper end of the connector 46, while a second engaging portion 46*b* is provided at the other end or lower end thereof as shown in FIG. 3. The connector 46 is used for coupling contact blocks constituting the switch. The coupled condition of the two blocks is illustrated in FIG. 12 and will be described more in detail later. In FIGS. 1 and 12, each of the pillar portions 18, 18 has an engaging step 44*a* on the upper part of the through hole 44. This engaging step 44*a* engages the second engaging portion 46*b* of the connector 46 and prevents the connector 46 from being separated from the pillar portion 18 when the lower end of the connector 46 is inserted through the upper opening of the through hole 44. The through hole 44 has a lateral hole 44*b* which extends laterally and opens outwards from the middle part of the through hole 44. The lateral hole 44*b* engages a first engaging portion 46*a*' formed at the upper end of the connector 46' inserted in the through hole 44' of the pillar portion 18' of the lower contact block 10' and engaged with the pillar portion 18', thus rigidly coupling the upper and lower two contact blocks 10 and 10' to each other. Each of the pillar portions 18, 18 preferably has a stopper portion 44C for preventing the connector 46 from being inserted unnecessarily deeply into the through hole 44**.

Referring again to FIG. 1, the side plate 12 has windows 48, 48. The windows 48, 48 are not absolutely necessary for embodying the invention but provide means for convenient and easy access to the contact points for inspection or cleaning thereof.

Figure 4A:
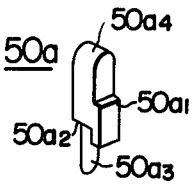
FIG. 4A is a perspective view showing an embodiment of the contact actuator member according to the present invention.
Figure 4B:
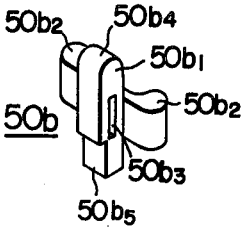
FIG. 4B is a perspective view showing another embodiment of the contact actuator member according to the present invention.
Figure 4C:
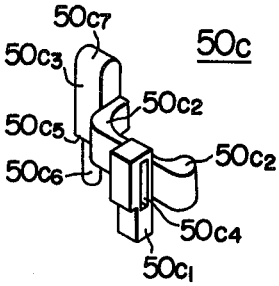
FIG. 4C is a perspective view showing still another embodiment of the contact actuator member according to the present invention.

Various types of contact actuator members are illustratively shown in FIGS. 4A, 4B and 4C. All of them have substantially the same length as the length of the casing along the coupling direction. The contact actuator members for embodying the present invention are not limited to the shown ones but it should be noted that various modifications are conceivable in actual design. The contact actuator member **50*a* shown in FIG. 4A has a stopper shoulder portion 50*a*$_1$ and a spring support step portion 50*a*$_2$ for holding a support spring. In making up a switch mechanism, the contact actuator member 50*a* is selectively used as required, and, as shown in FIG. 12, is inserted, for example, into the hole 30 of the casing 10. In the process, the spring support step portion 50*a*$_2$ of the contact actuator member 50*a* supports the upper end of the compression coil spring 52 and is urged upward by the spring 52. Once the contact actuator member 50*a* has been inserted into the hole 30 against the elasticity of the protrusion 40, the stopper shoulder 50*a*$_1$ thereof engages the protrusion 40 at the upper end of the cylinder portion 16 of the casing 10, so that the contact actuator member 50*a* is prevented from being separated outward by the force of the spring 52. The contact actuator member 50*a* further has a rod portion 50*a*$_3$ extending downward from the spring support step portion 50*a*$_2$. The rod portion 50*a*$_3$ passes through the coil spring 52 and is adapted to press the actuated portion of another contact actuator member thereby to actuate the same, if the particular another contact actuator member on the casing 10' of the lower contact block is located immediately below the contact actuator member 50*a* when the upper end or the actuated portion 50*a*$_4$ of the contact actuator member 50*a* protruded outward from the casing 10 is pressed downward by an external force against the urging force of the spring 52**.

Figure 5A:
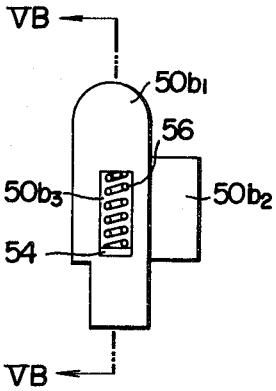
FIG. 5A is a side view showing a movable contactor carried on the contact actuator member shown in FIG. 4B.
Figure 5B:
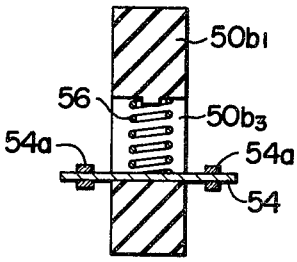
FIG. 5B is a sectional view of the contact actuator member of FIG. 5A along the line VB—VB.
Figure 6:
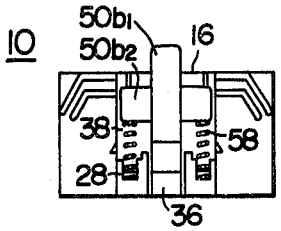
FIG. 6 is a front view of the casing of FIG. 1 on which the contact actuator member of FIG. 4B is mounted, illustrated without the side plate of the casing to make the inside thereof visible.

Another contact actuator member **50*b* is shown in FIG. 4B. The contact actuator member 50*b* includes a movable-contactor carrying portion 50*b*$_1$ and wings 50*b*$_2$ extending laterally therefrom in both directions. A lateral through hole 50*b*$_3$ is formed in the middle part of the contactor carrying portion 50*b*$_1$. The contact actuator member 50*b* has an actuated portion 50*b*$_4$ similar to that provided on the contact actuator member 50*a*. In assemblying the contact block, a movable contactor 54 is built in the through hole 50*b*$_3$, as shown in FIGS. 5A and 5B. As shown in FIGS. 5A and 5B, the movable contactor 54 is inserted into the hole 50*b*$_3$ and supported in the hole 50*b*$_3$ while being biased downward by a spring 56. The contact actuator member 50*b* selected as required and built into the movable contactor in assemblying the contact block is incorporated into the casing 10 in that way. FIG. 6 shows the contact actuator member 50*b* as built in the casing 10. In this drawing, neither the movable contactor 54 built in the contact actuator member 50*b*, nor the lead-out terminal 20 on the fixed contact point, nor the side plate 12 is shown to facilitate the understanding. In the process of assemblying the contact block, the contact actuator member 50*b* is contained in the space 38. Springs 58, 58 are inserted between the lower sides of the wings 50*b*$_2$, 50*b*$_2$ of the contact actuator member 50*b* and the mounts 28, 28 of the base portion 14 respectively, thereby urging the wings 50*b*$_2$, 50*b*$_2$ upward. Once the contact actuator member 50*b* has been inserted into the space 38 against the elasticity of the protrusion 42, however, the protrusion 42, though not visible in FIG. 6, provided on the upper end of the cylinder portion 16 holds the upper surface of the central portion of the wings thereby to prevent separation of the contact actuator member 50*b***.

In this way, the central portion of the wings also functions as a stopper shoulder.

Figure 7:
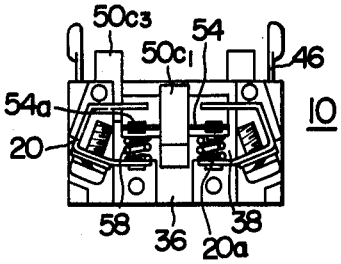
FIG. 7 is a front view showing the casing of FIG. 1 engaged with the connectors of FIG. 3 with two contact actuator members of FIG. 4C mounted to make up a normally open contact, illustrated to make the inside of the casing visible by removing the side plate thereof.

Still another contact actuator member 50c is illustrated in FIG. 4C. The contact actuator member 50c has a form in which the contact actuator members 50a and 50b are substantially combined. The contact actuator member 50c comprises a movable-contactor carrying portion $50c_1$, wings $50c_2$, $50c_2$ laterally extending in both directions from the movable contactor carrying portion $50c_1$, and an actuating portion $50c_3$ provided at an end of one of the wings. In the middle part of the movable-contactor carrying portion $50c_1$, a lateral through hole $50c_4$ is formed to function the same way as the hole $50b_3$ of the contact actuator member 50b. The diagram of FIG. 7 shows the manner in which the contact actuator member 50c and the lead-out terminals 20, 20 are built in the casing 10. To facilitate the understanding, the side plate 12 of the casing is not shown. Prior to incorporating the contact actuator member 50c into the casing 10, the movable contactor 54 is inserted into the lateral hole $50c_4$ and supported by the spring in the same manner as mentioned about the contact actuator member 50b with reference to FIGS. 5A and 5B. The contact actuator member 50c with the movable contactor 54 built therein is mounted in the casing 10, while the actuating portion $50c_3$ is inserted into the hole 30. The movable-contactor carrying portion $50c_1$ with the movable contactor 54 therein is contained in the space 38. The wings $50c_2$, $50c_2$ formed in substantially L shape are contained in a space consisting of the space 38 and the hole 30. At the same time, in the same manner as described with reference to FIG. 6 about the contact actuator member 50b, springs 58, 58 are inserted between the lower sides of the wings of the contact actuator member 50c and the mounts 28, 28, which springs 58, 58 urge the contact actuator member 50c upward. The actuating portion $50c_3$ has a spring support step portion $50c_5$ similar to the spring support step portion $50a_2$. The rod portion $50c_6$ extends downward from the step portion $50c_5$. Between the step portion $50c_5$ and the base portion 14 is inserted a coil spring similar to the coil spring 52 described with reference to FIG. 12 about the contact actuator member 50a. The coil spring under consideration urges the contactor actuator member 50c upward in cooperation with the coil springs 58, 58. The contact actuator member 50c is, however, prevented from being separated outside since the wings $50c_2$, $50c_2$ are held by the protrusions 42, 40 formed at the upper end of the cylinder 16. The actuating portion $50c_3$ has at its upper end an actuated portion $50c_7$ protruding outward from the casing 10 and similar to that mentioned about the contact actuator member 50a. When the actuated portion $50c_7$ is pressed downward, the actuating portion $50c_3$ is guided by the hole 30, so that the movable-contactor carrying portion $50c_1$ is guided by the space 36 and the contact points 54a, 54a formed on the movable contactor 54 are brought into contact with the fixed contact points 20a, 20a of the lead-out terminals 20, 20. The fact that the movable contactor 54 is urged by the spring 56 downward assures satisfactory contacted conditions.

The contact actuator members 50a, 50b and 50c are naturally made up of electrically insulating material such as synthetic resin or other.

In FIG. 7, the fixed contact point of the lead-out terminal 20 is located below the movable contact point to make up a normally open contact. But it may of course be located alternatively above the movable contact point to make up a normally closed contact, as will be easily understood. In that case, the spring 56 shown in FIG. 5B is located between the lower side of the movable contactor 54 and the lower end of the hole $50b_3$ thereby to urge the movable contactor 54 upward. It will also be easily understood that it is possible to form both a normally-closed contact and a normally-open contact by providing both pairs of upper and lower fixed contact points of the lead-out terminal 20. In this case, a spring is preferably located on each of the upper and lower sides of the movable contactor and supported at the central part of the hole $50b_3$.

Figure 8:
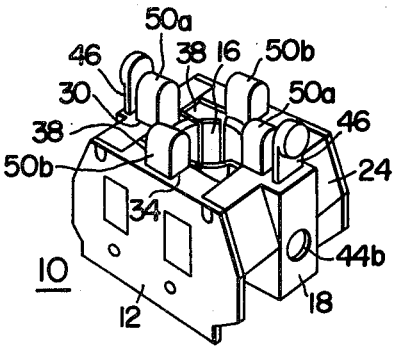
FIG. 8 is a perspective view showing a finished contact block with two contact actuator members of FIG. 4A and two contact actuator members of FIG. 4B.
Figure 9:
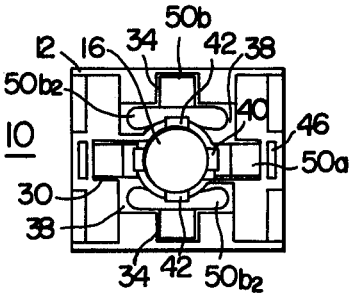
FIG. 9 is a top plan view showing the contact block of FIG. 8.
Figure 10:
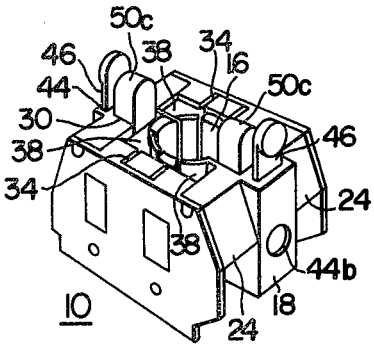
FIG. 10 is a perspective view showing a contact block in its complete form using two contact actuator members shown in FIG. 4C.
Figure 11:
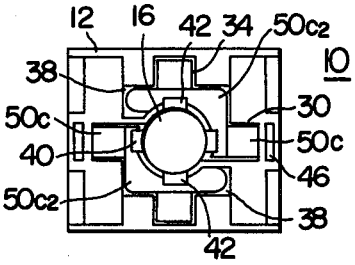
FIG. 11 is a top plan view showing the contact block of FIG. 10.

FIGS. 8 and 9 show embodiments wherein a contact block includes two contact actuator members 50a, 50a and two contact actuator members 50b, 50b. FIGS. 10 and 11 are diagrams showing another embodiment of a contact block including two contact actuator members 50c.

FIG. 12 shows a construction consisting of a first contact block as shown in FIGS. 8 and 9 placed on upper side, and a second contact block as shown in FIGS. 10 and 11 placed on lower side, which are coupled to each other by means of connectors 46', 46'. In this case, when one of the contact actuator members 50b, 50b of the upper contact block is pressed down, the contact mechanism associated therewith is actuated but the lower contact block is not affected at all. This is because the contactor carrying portion $50c_1$ of the contact actuator member 50c of the lower contact block which is located immediately under the contactor carrying portion $50b_1$ of the contact actuator member 50b of the upper contact block has no actuated portion. In the case where one of the contact actuator members 50a, 50a of the upper contact block is pressed downward, on the other hand, the contact mechanism of the upper first contact block is not affected since the contact actuator member 50a is not carrying the movable contactor. In spite of this, by pressing down the contact actuator member 50a, the actuated portion $50c_7$ of the contact actuator member 50c of the second contact block immediately below the contact actuator member 50a is pressed down and therefore the contact mechanism associated with the contact actuator member 50c is actuated. In the process, the rod-like portion $50c_5$ of the contact actuator member 50c pressed down moves downward so that, if still another (third) contact block is coupled below the second contact block, the rod-like portion $50c_5$ presses down the actuated portion of a contact actuator member, if any, immediately thereunder.

The form of the contact actuator members is not limited to those shown by reference numerals 50a, 50b and 50c, but may be modified in various ways. For instance, the contact actuator member 50c may be modified in such a manner that the wing $50c_2$ and the actuating portion $50c_3$ are symmetrically reversed with respect to the contactor carrying portion $50c_1$. Further, the upper end portion of the movable contact carrying portion $50c_1$ of the contact actuator member 50c may be further extended upward to form another actuated portion similar to the actuated portion $50a_4$ of the contact actuator member 50a. In this case, the actuated portion $50c_7$ of the actuating portion $50c_3$ may be done without. Instead, the actuated portion $50c_7$ may be left unremoved so that whole of the contact actuator member 50c may be actuated by pressing of either of the actuated portions.

Figure 13:
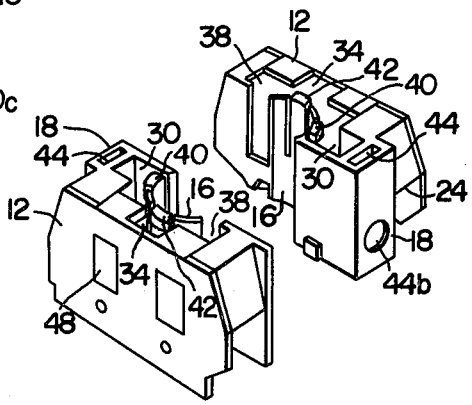
FIG. 13 is a perspective view showing the casing of FIG. 1 constructed of two independent component parts.

The diagram of FIG. 13 shows a pair of divided contact blocks. Only one of them is usable when selected one of normally-open contact or normally-closed contact is employed. If they are combined, both of the contact blocks may of course be used as one unit similar to that of FIG. 1.

Figure 14:
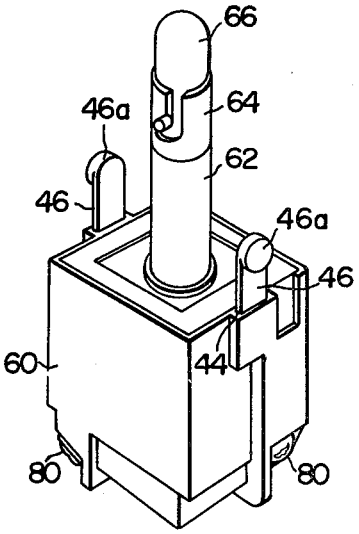
FIG. 14 is a perspective view of a transformer block according to the present invention.

A transformer block is shown in FIG. 14. The transformer block comprises a casing 60 containing an ordinary transformer 90. The primary winding 92 of transformer 90 is connected to a pair of input terminals 80, 80 which are to be connected to an external power supply, while the secondary winding 94 thereof is connected to a pair of output terminals 70 and 74 for supplying power to a lamp 66. The lamp 66 is supplied with power from the output terminals through a lead-out member 62 and a socket 64. On each side of the casing 60, there is an engaging hole 44 into which the lower end of the connector 46 is adapted to be engagingly fitted. The engaging hole 44 has an engaging portion similar to that described with reference to FIG. 12, which is adapted to be engaged with the engaging portion **46*b* (FIG. 3) of the connector 46**.

It will be easily understood that the transformer block with the above-mentioned construction may be coupled and interlocked with the contact block shown in FIG. 8 or 10. For the purpose of coupling it to the contact block, all that is required is a simple process of inserting the lamp 66 and the lead-out cylinder thereof into the cylinder portion 16 from underside of the contact block as shown in FIG. 8 or 10 so that the engaging portion **46*a* of each connector 46 of the transformer block engages the engaging hole 44*b*** of the contact block.

Figure 15:
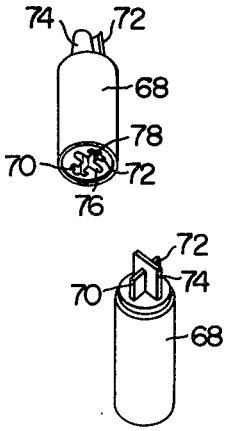
FIG. 15 is a perspective view showing a relaying lead-out member to be used with the transformer block of FIG. 14.

The diagram of FIG. 15 shows two relay lead-out cylinders 68 with the same construction. Each of the cylinders 68 is insulatively embedded with a pair of conductors 70, 72. The upper ends of the conductors 70, 72 are protruded and arranged in alignment with each other on both sides of the insulated protrusion 74, and form substantially a cross with the insulated material 74. The lower ends of the conductors 70, 72 are not protruded from the cylinder portion but flush with the end of the cylinder. The lower end portion of the cylinder portion has a cross recess into which the upper end portion of the cylinder, the upper end protrusion of the conductor and the insulating protrusion are adapted to be fitted. One of the slots of the cross recess is designated by reference numeral 76 and has an insulated protrusion 74 fitted thereinto. The other slot of the recess is designated by numeral 78 and perpendicular to the slot 76. The slot 78 transverses the lower ends of the conductors 70, 72 which are arranged in parallel and has the upper end protrusions of the conductors 70, 72 fitted thereinto respectively, thus establishing superior electrical contact with the lower ends of the conductors 70, 72 respectively.

Although it is not yet shown in or described with reference to FIG. 14, the coupling section between the lead-out cylinder 62 and the casing 60 of FIG. 14 may have the same construction as the coupling section of the relaying lead-out member 68 shown in FIG. 15. The lead-out member 62 may be removed from the casing 60 so that a required number of the relaying lead-out members 68 may be inserted between the casing 60 and the lead-out member 62. The lead-out member 62 may be either irremovably coupled directly with the socket portion 64 by soldering or the like, or have the same construction as the coupling section of the relay lead-out member 68. In the latter case, the lead-out member 62 may have quite the same configuration as the relaying lead-out member 68.

The contact block with the above-mentioned configuration according to the invention is easily mounted on such a well-known operating unit as a push button to make up a switch mechanism by providing an engaging hole for the engaging portion **46*a* of the connector 46**, for instance, at the lower part of the operating unit.

In the case where a plurality of contact blocks are coupled in multiple stages by use of the connector 46 to operate it as a push button switch, only the contact actuator members **50*b* are used among the various kinds of contact actuator members. When the push button operating unit presses the contact actuator member 50*b* of the contact block in upper stage, the contact actuator member 50*b* is pressed downward against the support spring. This causes the contact actuator member 50*b* of the next contact block immediately below to be also pressed down by the contact actuator member 50*b*** of the contact block in the upper stage. As a result, the contact actuator member of each stage functions as an ordinary multi-stage push button switch for simultaneously actuating the contactor carried by each contact actuator member.

In the case where the operating modes of the upper and lower contact blocks are desired to be differentiated in multi-stage construction, for example, two contact actuator members **50*a* and two contact actuator members 50*b* are used for the upper contact block as shown in FIG. 12. In other words, the contact block of the upper stage includes two contact actuator members 50*a*, 50*a* inserted into the through holes 30, 30 and two contact actuator members 50*b*, 50*b* into the through holes 34, 34 as shown in FIGS. 8 and 9, while the contact block of the lower stage has two contact actuator members 50*c*, 50*c* inserted as shown in FIGS. 10 and 11. These two contact blocks 10, 10′ are laid one on the other and secured to each other with connectors 46, 46. This multi-stage contact blocks 10, 10′ may be coupled with an operating unit such as a selector mechanisn (not shown) by inserting the engaging portions 46*a*, 46*a* of the connectors 46, 46 of the upper stage contact block 10 shown in FIG. 12 into the engaging holes provided at the under side of the selector mechanism (not shown). The first, second, third and fourth contact actuator members 50*b*, 50*a*, 50*b* and 50*a* of the upper stage contact block 10 are pressed down sequentially in that order clockwise or counterclockwise. When the first contact actuator member 50*b* of the upper contact block 10 is first pressed down, the movable contactor carried in the hole $50b_3$ thereof is actuated thereby to open or close the contact associated therewith. But having no actuated portion immediately under the lower portion $50b_5$ of the pressed down contact actuator member 50*b* of the upper contact block 10, with the actuator members 50*c*, 50*c* of the lower contact block 10′ can not be pressed down. Next, when the second contact actuator member 50*a* of the upper contact block 10 is pressed down, the actuated portion $50c_7$ of the first contact actuator member 50*c* of the lower contact block 10′ which is placed immediately under the actuating rod portion $50a_3$ of the pressed down actuator member 50*a* of the upper contact block 10 is pressed down, and therefore the movable contact carrying portion $50c_1$ integrated is pressed down, so that the movable contactor supported in the hole $50c_4$ of the pressed down contact actuator member 50*c*** is actuated thereby to open or close the contact point associated therewith.

The next selector operation actuates the third contact actuator member 50*b* of the upper contact block, followed by the actuation of the fourth contact actuator member 50*a*, in a manner similar to the operation of the first and second contact actuator members 50*b* and 50*a*, thus completing a cycle of operation. In this way, the upper and lower contact blocks are operated in different ways, thereby providing a simple selector switch.

Further, the contact blocks according to the present invention may be provided with a push button operating unit with an illuminating lens. In that case, a transformer block as shown in FIG. 14 may be mounted on the lower side of the contact block at the lowest stage. Since the central lead-out member 62 is passed upward through the central hollow cylinder 16 of the contact block to permit access to the illuminating lens surface of the uppermost lamp 66, a simple construction of the switch with an indication lamp is made possible.

In the case where a given number of contact blocks according to the present invention are laid one on another, the same number of relaying lead-out members 68 shown in FIG. 15 may be used to provide a switch apparatus with an indication lamp comprising contact blocks in multi-stages.

It will be understood from the foregoing description that according to the present invention, a desired number of contact blocks may be easily coupled to each other by means of the connectors 46. In addition, by selecting the contact actuator members suited to a specific object, the operation mode of the upper and lower contact blocks may be modified, so that the selection of the operation mechanism section enables a configuration of a multi-stage switch having the selector functions.

Furthermore, by inserting the lead-out member 62 of the transformer mounted at the lower end through the cylinder portion 16 at the center of the contact block, the lamp 66 at the upper end of the lead-out member 62 may be placed in opposition to the operating unit with an illumination lens which is mounted on the upper side of the uppermost contact block, thereby providing a switch with an indication lamp easily which may be very effectively used with an operating circuit or the like requiring a complicated circuit configuration.

In the foregoing description, the connectors 46 were used as means for coupling the contact blocks with each other, the contact block with the operating unit, or with the transformer block. The positional relations of the engaging portions 44*a*, 44*b*, and 44*c* to be engaged with the connectors 46, provided on the contact block and the transformer block, may of course be reversed upside down to use the connectors 46 in vertically reverse relations. In the embodiments shown in the accompanying drawings, the lower engaging portion 46*b* of the connector 46 is so constructed that once it has been inserted into the upper part of the engaging hole 44 of the casing, it engages the stopper engaging portion 44*a* and cannot be pulled out any longer. The upper engaging portion 46*a* of the connector 46, by contrast, is such that even if it is inserted from underside of the engaging hole 44 of the casing, it may be easily disengaged from the hole 44*b* by pressing the engaging portion 46*a*. In other words, the upper engaging portion 46*a* is removably engaged. This engaging relation may be reversed in such a manner that the engagement at the upper part of the engaging hole 44 is releasable, while that of the lower part thereof is irremovable. As another alternative, both engagements may be made releasable as desired, though the irremovable engaging relation is expected to lead to a stronger connection. The connector 46 is not necessarily constructed independently but may be integrated with the casing 10 of the contact block or the casing 60 of the transformer block. Such a modification is also included in the scope of the present invention. In that case, the upper half of the pillar portion 18 of the casing 10 is solid, and the coupling portion with the engaging portion 46*a* as shown in FIG. 3 rises integrally from the upper surface of the upper solid part of the pillar portion 18, while the lower half of the pillar portion 18 is provided with the engaging hole 44*b* as mentioned earlier, as will be easily noted. Another alternative is that the positional relation is so reversed that the lower half of the pillar portion 18 is made solid and the coupling portion with the engaging portion 46*a* integrally falls down from the lower side of the solid portion, with the engaging hole 44*b* provided at the upper half of the pillar portion 18. In spite of this, separate construction of the connectors is more advantageous than the integrated one thereof in many respects. Firstly, the connectors, if integrated, are a bulky stock of parts prior to the assembly of the contact blocks. Producing the connectors separately, on the other hand, offers an advantage of compactness because of substantially the cubic form of the casing. Also, since the connectors requires elasticity, they are hard to be made of a comparative cheap thermosetting resin. But, the casing may be made of such thermosetting resin because it does not require such elasticity. Accordingly, if the connectors are made integrally with the casing, it is necessary to use more expensive thermoplastic resin materials such as polyacetal or polycarbonate for the formation of the whole configuration.

The hollow portion 16 provided at the center of the casing 10 of the contact block is used for leading out the signal lamp and is not limited to such a cylindrical form as shown in the drawings but may assume such a form as hollow prism-like pillar with a triangle or polygonal section.

I claim:

1. A switch apparatus including at least one contact block which is adapted to be coupled directly against other contact blocks similar thereto in multi-stages, said contact block comprising:

a casing of an electrical insulating material having a central axis;

means for mechanically coupling said casing into direct contact with a casing of another contact block having a configuration similar to that of said contact block, along a common axis including the respective central axes of said casing and the casing of said other contact block, in order to couple said contact block with said other contact block;

at least one set of electrical contact means contained in said casing and including a contactor for actuating said contact means;

contact actuator means of an electrical insulating materail carrying said contactor, said contact actuator means being contained in said casing and supported movably in parallel to said central axis between first position where said contact means is unactuated and a second position where said contact means is actuated, said contact actuator means having a first predetermined length substantially equal to the length of said casing along said central axis, said contact actuator means including a contactor carrying portion for carrying said contactor, at least one actuated portion protruded in the direction parallel to said central axis by a second predetermined length outwardly of one surface of said casing perpendicular to said central axis of said casing, to receive an external force, when said contact actuator means is in said first position, and at least one actuating portion adapted to be come in an abutment contact with an end of the actuated portion of the contact actuator means of said other contact block when said contact block is coupled with said other contact block;

bias means for applying a bias force to said contact actuator meeans in order to normally urge said contact actuator means to said first position; and said contact actuator means being at least one of a first contact actuator member and a second contact actuator member selected in assemblying said contact block, said first contact actuator member including a first body portion elongated along a first axis, said first body portion including an actuated portion, a contactor carrying portion and an actuating portion aligned along said first axis, said actuated portion, said contactor carrying portion and said actuating portion of said first body portion being equivalent to said actuated portion, contactor carrying portion and actuating portion of said contact actuator means respectively, said second contact actuator member including a second body portion elongated along a second axis, a third body portion elongated along a third axis in parallel to said second axis, and a coupling portion coupling said second and third body portions to each other, a contactor carrying portion equivalent to said contactor carrying portion of said contact actuator means being formed on selected one of said second and third body portions, at least one actuated portion equivalent to said actuated portion of said contact actuator means being formed on at least one of said second and third body portions, at least one actuating portion equivalent in size to said actuating portion of said contact actuator means being formed on at least one of said second and third body portions.

2. A switch apparatus according to claim 1, in which said contact means includes at least a pair of fixed contact points separated from each other and adapted to be electrically connected to external circuits respectively, and at least a pair of movable contact points carried by said contactor and electrically connected to each other.

3. A switch apparatus according to claim 2, in which said contact means includes at least selected one of a normally-closed contact and a normally-open contact.

4. A switch apparatus according to claim 2, in which said contact means includes at least one normally-closed contact and at least one normally-open contact.

5. A switch apparatus according to claim 1, in which said contact block includes another contact actuator means of electrically insulating material contained in said casing and supported movably between a third position and a fourth position in parallel to said central axis, said other contact actuator means being normally urged to said third position by another bias means, said other contact actuator means having the length equal to said first predetermined length along the direction of the movement of said another contact actuator means, said another contact actuator means having an actuated portion and an actuating portion which are longitudinally aligned and correspond to said actuated portion and said actuating portion of said first mentioned contact actuator means respectively, said actuated portion of said other contact actuator means being protruded outwardly of said one surface of said casing by said second predetermined length when said other contact actuator means is located in said third position.

6. A switch apparatus according to claim 1, in which said casing comprises a hollow pillar portion integrally formed with said casing which has a center hole including said central axis and passing through said pillar portion along said central axis, said center hole being used to allow a lamp and electrical power feeding means therefore to penetrate therethrough when they are used for the switch.

7. A switch apparatus according to claim 6, in which said hollow pillar portion takes the form of hollow cylinder.

8. A switch apparatus according to claim 6, in which said hollow pillar portion takes the form of hollow prism.

9. A switch apparatus according to claim 1, in which said casing comprises a pair of conductors electrically separately embedded in an insulating material integrally with said casing and passing through said casing along said central axis, input terminal means connected with an end of each of said conductors, and output terminal means connected with the other end of each of said conductors, said output terminal means being mounted on said one surface of said casing, said input terminal means being mounted on the other surface opposite to said one surface of said casing.

10. A switch apparatus according to claim 6, in which said switch apparatus further comprises a transformer block removably coupled to said contact block along said central axis, said transformer block including a transformer with a primary winding and a secondary winding, a casing containing said transformer, mechanically coupling means for coupling said transformer block casing and said contact block casing with each other by bringing one surface of said transformer block casing into an abutment contact with the other surface opposite to said one surface of said contact block casing, output terminal means located at substantially the central portion of said one surface of said transformer block casing and electrically connected with said secondary winding, and input terminal means electrically connected to said primary winding and adapted to be connected to an external power supply; and in which said switch apparatus further comprises a lamp located on said one surface of said contact block casing and means for electrically connecting said lamp to said output terminal means of said transformer block through said center hole.

11. A switch apparatus according to claim 10, in which said means for electrically connecting said lamp to said output terminal means of said transformer block includes a rod-like lead-out member of an electrically insulating material electrically separately embedded with a pair of conductors and a lamp socket for receiving said lamp, said rod-like lead-out member having the length substantially equal to the length of said contact block casing along said central axis, said rod-like lead-out member including input terminal means and output terminal means at one end and the other end thereof respectively, said pair of embedded conductors being connected electrically between said input and output terminal means of said lead-out member, said input terminal means of said rod-like lead-out member being electrically connected with said output terminal means of said transformer block, said lamp socket including input terminal means for supplying current to said lamp, said input terminal means of said lamp socket being connected electrically to said output terminal means of said rod-like lead-out member.

12. A switch apparatus according to claim 11, in which said output terminal means of said contact block and said output terminal means of said rod-like lead-out member having geometrically similar shapes, said input terminal means of said rod-like lead-out member and said input terminal means of said lamp socket having geometrically similar shapes complementary to the shape of said terminal means and said lead-out member.

13. A switch apparatus according to claim 1, in which said casing coupling means including a pair of coupling portions formed integrally with said casing of said contact block and protruded outward from said one surface of said casing, each of the free ends of said coupling portions having an engaging portion, the other surface opposite to said one surface of said casing having a pair of engaging holes formed at a predetermined position therein, said engaging holes being so constructed that when said contact block is coupled with another contact block, the engaging portions formed at the free ends of a pair of similar coupling portions formed integrally with the casing of said other contact block is fittingly inserted into and removably firmly engages said respective engaging holes.

14. A switch apparatus according to claim 10, in which said casing coupling means of said contact block including a pair of coupling portions formed integrally with said casing of said contact block and protruded outward from said one surface of said casing, each of the free ends of said pair of coupling portions having an engaging portion, the other surface opposite to said one surface of said casing of said contact block having a pair of engaging holes formed therein, said engaging hole being so constructed that when said contact block is coupled with another contact block, the engaging portions formed at the free ends of a pair of similar coupling portions integrally formed on the casing of said other contact block is fittingly inserted into and removably firmly engages said respective engaging holes, said casing coupling means of said transformer block including a pair of coupling portions having the same shape as said pair of said coupling portions of said contact block and formed integrally on said one surface of said transformer block casing in the same positional relation as said pair of said coupling portions of said contact block, said pair of coupling portions of said transformer block including engaging portions formed at the respective free ends thereof, said engaging portions being fittingly and removably inserted into and firmly engaging corresponding engaging holes formed in said contact block casing.

15. A switch apparatus according to claim 1, in which said casing coupling means include a pair of coupling portions formed integrally with said casing of said contact block and protruded outward of the other surface opposite to said one surface of said casing, each of the free ends of said pair of said coupling portions of said casing coupling means including an engaging portion, said casing including a pair of engaging holes formed in said one surface, the engaging portions formed at the respective free ends of a pair of similar coupling portions integrally formed on the casing of another contact block being fittingly and removably inserted into and firmly engaging said engaging holes when said contact block is coupled with said other contact block.

16. A switch apparatus according to claim 10, in which said casing coupling means of said contact blocking includes a pair of coupling portions formed integrally with said casing of said contact block and protruded outward of the other surface opposite to said one surface of said casing, each of the free ends of said pair of said coupling portions being formed with an engaging portion, said casing of said contact block having a pair of engaging holes formed in said one surface in a manner so that when said contact block is coupled with another contact block, the engaging portions formed at the respective free ends of a pair of coupling portions integrated with the casing of said other contact block is fittingly and removably inserted and firmly engages said engaging holes, said casing coupling means of said transformer block including a pair of engaging holes formed in said one surface of the casing of said transformer block in the same shape and the same positional relation as said pair of said engaging holes formed in said casing of said contact block, said engaging portions of said coupling portions of said contact block casing being fittingly and removably inserted into and firmly engaging corresponding ones of said engaging holes of said transformer block.

17. A switch apparatus according to claim 1, in which said casing coupling means includes a pair of coupling members separately formed from said casing, each of said pair of said coupling members including first and second engaging portions at the opposite ends thereof respectively, said casing having a first pair of engaging holes formed in said one surface thereof, said first engaging portion of said pair of said coupling members being adapted to be fittingly inserted into and firmly engaging said first pair of engaging holes, said casing having a second pair of engaging holes formed in the other surface opposite to said one surface, said second engaging portion of said pair of said coupling members being adapted to be fittingly inserted into and firmly engaging said second pair of engaging holes, said other surface of said casing being adapted to be brought into an abutment contact with one surface of the casing of said other contact block when said second engaging portions of said pair of coupling portions engage said second pair of engaging holes of said casing and said first engaging portions engage the first engaging holes of the casing of said other contact block.

18. A switch apparatus according to claim 17, in which one of the engaged relations between each of said first engaging portions and each of said first engaging holes and between each of said second engaging portions and each of said second engaging holes is a removable engagement, the other of said relations being an irremovable engagement.

19. A switch apparatus according to claim 17, in which both of the engaged relation between each of said first engaging portions and each of said second engaging holes and between each of said second engaging portions and each of said second engaging holes are removable engagements.

20. A switch apparatus according to claim 10, in which each of said casing coupling means of said contact block and said casing coupling means of said transformer block includes a pair of coupling members, each of said coupling members having first and second engaging portions at the opposite ends thereof respectively, said one surface of said contact block casing including a first pair of engaging holes so constructed that said first engaging portions of said pair of coupling members are adapted to be fittingly inserted into and firmly engage corresponding ones of said first pair of engaging holes, the other surface opposite to said one surface including a second pair of engaging holes so constructed that said second engaging holes of said pair of coupling members are adapted to be fittingly inserted into and firmly engage corresponding ones of said second pair of engaging holes, said one surface of said transformer block including a pair of engaging holes positionally corresponding to said first engaging holes of said contact block casing, said other surface of said contact block being adapted to be brought into an abutment contact with said one surface of said transformer block when said second engaging portions of said pair of coupling members engage said second pair of engaging holes of said contact block casing and said first engaging portions engage said first engaging holes of said transformer block.

21. A switch apparatus according to claim 20, in which one of the engaged relations between each of said first engaging portions and each of said first engaging holes and between each of said second engaging portions and each of said second engaging holes is a removable engaged relation, the other of said engaged relations being an irremovable engaged relation.

22. A switch apparatus according to claim 20, in which both of the engaged relations between each of said first engaging portions and each of said first engaging holes and between each of said second engaging portions and each of said second engaging holes are removably engaged relations.

23. A switch apparatus according to claim 6, in which said casing includes a space defined by walls surrounding said casing and wall of said hollow pillar portion, said space containing said contact means and said contact actuator means, said hollow pillar portion having a plurality of slits in the vicinity of said one surface of said casing, at least one outward radial protrusion being formed between adjacent ones of said slits thereby to provide radial elasticity to the portions including said protrusion, said contact actuator means having a portion adapted to engage said protrusion thereby to prevent said contact actuator means from jumping out of said space by the bias force of said bias means so that said contact actuator means are normally urged to said first position once said contact actuator means has been contained in said space against said elasticity.

24. A switch apparatus according to claim 9, in which said apparatus further comprises a transformer block removably coupled to said contact block along said central axis, said transformer block including a transformer with a primary winding and a secondary winding, a casing for containing said transformer, coupling means for coupling the casings of said transformer block and said contact block with each other by bringing one surface of said transformer block casing into an abutment contact with said other surface of said contact block casing, output terminal means provided at substantially the central portion of said one surface of said transformer block casing and electrically connected to said secondary winding, and input terminal means electrically connected to said primary winding and adapted to be connected to an external power supply; and wherein said apparatus further comprises a lamp, and a socket for receiving said lamp, said socket including input terminal means, said output terminal means of said contact block and said output terminal means of said transformer block having geometrically similar shapes, said input terminal means of said contact block and said input terminal means of said socket having geometrically similar shapes complementary to said output terminal means of said contact block and said transformer block, respectively.

25. A switch apparatus including at least a contact block which is adapted to be coupled directly against other contact blocks similar thereto in multiple stages, said contact block comprising:

a casing of an electrical insulating material having a central axis and a hollow pillar portion integrally formed with said casing, said hollow pillar portion having a center hole including and formed along said central axis, said center hole being used to allow for a lamp and electrical power feeding means therefore to penetrate therethrough when they are used for the switch;

means for coupling mechanically said casing directly against a casing of another contact block having a configuration similar to that of said contact block, along a common axis including the respective central axes of said casing and the casing of said other contact block in order to couple said contact block with said other contact block;

at least one set of electrical contact means contained in said casing and including a contactor for actuating said contact means;

contact actuator means of electrical insulating material and carrying said contactor, said contact actuator means being contained in said casing and supported movably in parallel to said central axis between a first position where said contact means is unactuated and a second position where said contact means is actuated, said contact actuator means having a first predetermined length substantially equal to the length of said casing along said central axis, said contact actuator means including a contactor carrying portion for carrying said contactor, at least one actuated portion protruded in the direction parallel to said central axis by a second predetermined length outwardly of one surface of said casing perpendicular to said central axis of said casing, to receive an external force, when said contact actuator means is in said first position, and at least one actuating portion adapted to be brought into an abutment contact with the end of the actuated portion of the contact actuator means of said other contact block when said contact block is coupled with said other contact block; and bias means for applying a bias force to said contact actuator means for normally urging said contact actuator means to said first position.

26. A switch apparatus according to claim 25, in which said hollow pillar portion assumes a form of hollow cylinder.

27. A switch apparatus according to claim 25, in which said hollow pillar portion assumes a form of hollow prism.

28. A switch apparatus according to claim 25, in which said apparatus further comprises a transformer block removably coupled to said contact block along said central axis, said transformer block including a transformer with a primary winding and a secondary winding, a casing containing said transformer, means for coupling said casing of said transformer block and said casing of said contact block to each other by bringing one surface of said transformer block casing into an abutment contact with the other surface of said contact block casing opposite to said one surface thereof, output terminal means provided at substantially the central portion of said one surface of said transformer block casing and electrically connected to said secondary winding, and input terminal means electrically connected to said primary winding and adapted to be connected to an external power supply; and in which said apparatus further comprises a lamp and means for electrically connecting said lamp to said output terminal means through said center hole.

29. A switch apparatus according to claim 28, in which said means for electrically connecting said lamp to said output terminal means includes a rod-like lead-out member of an electrically insulating material separately embedded with a pair of conductors, and a lamp socket for receiving said lamp, said rod-like lead-out member having the length substantially equal to the length of said contact block casing along said central axis, said rod-like lead-out member having at the opposite ends thereof input terminal means and output terminal means respectively, said embedded pair of conductors being electrically connected between said output terminal means and said input terminal means, said input terminal means of said rod-like lead-out member being electrically connected with said output terminal means of said transformer block, said lamp socket having input terminal means for supplying current to said lamp, said lamp socket input terminal means being electrically connected to said output terminal means of said rod-like lead-out member.

30. A switch apparatus according to claim 29, in which said output terminal means of said contact block and said output terminal means of said rod-like lead-out member having geometrically similar shapes, said input terminal means of said rod-like lead-out member and said input terminal means of said lamp socket having geometrically similar shapes complementary to said shape of said output terminal means and said lead-out member, respectively.

* * * * *

UNITED STATES PATENT AND TRADEMARK OFFICE

CERTIFICATE OF CORRECTION

PATENT NO. : 4,157,463

DATED : June 5, 1979

INVENTOR(S) : Teizo Fujita

It is certified that error appears in the above-identified patent and that said Letters Patent are hereby corrected as shown below:

On the title page,
" Filed: August 3, 1977" should read
-- Filed August 30, 1977 --.

Signed and Sealed this

*Twenty-eighth* Day of *August 1979*

[SEAL]

*Attest:*

*Attesting Officer*

LUTRELLE F. PARKER

*Acting Commissioner of Patents and Trademarks*